US005394634A

United States Patent [19]

Vang et al.

[11] Patent Number: 5,394,634

[45] Date of Patent: * Mar. 7, 1995

[54] SHOTGUN BARREL

[75] Inventors: Hans J. Vang, 340 Old Mill Rd. #10, Santa Barbara, Calif. 93110; Carl D. Calos, Lompoc, Calif.

[73] Assignee: Hans J. Vang, Santa Barbara, Calif.

[ * ] Notice: The portion of the term of this patent subsequent to Oct. 5, 2010 has been disclaimed.

[21] Appl. No.: 164,203

[22] Filed: Dec. 8, 1993

Related U.S. Application Data

[60] Continuation-in-part of Ser. No. 985,328, Dec. 4, 1992, Pat. No. 5,272,827, which is a division of Ser. No. 856,512, Mar. 24, 1992, Pat. No. 5,249,385.

[51] Int. Cl.[6] ..... F41A 21/40

[52] U.S. Cl. ..... 42/79; 89/14.05

[58] Field of Search ..... 42/79, 76.01; 89/14.05

[56] References Cited

U.S. PATENT DOCUMENTS

| | | | |
|---|---|---|---|
| 14,597 | 4/1856 | Buckel et al. . | |
| 157,008 | 11/1874 | Kerr . | |
| 618,901 | 2/1899 | Peterson . | |
| 863,431 | 8/1907 | Parker . | |
| 1,858,560 | 5/1932 | Rosenstiel . | |
| 2,054,132 | 9/1936 | Lewis . | |
| 2,323,306 | 7/1943 | Campbell . | |
| 2,742,821 | 4/1956 | Sweetman . | |
| 2,972,800 | 2/1961 | Sterba et al. | 29/1.1 |
| 3,138,991 | 6/1964 | Malter | 89/14.3 |
| 4,058,925 | 11/1977 | Lende et al. | 29/1.1 |
| 4,071,971 | 2/1978 | Tornas . | |
| 5,155,291 | 10/1992 | Dabrowski | 89/14.05 |

FOREIGN PATENT DOCUMENTS

| | | | |
|---|---|---|---|
| 61107 | 7/1943 | Denmark | 89/14.05 |
| 364168 | 8/1906 | France | 42/76.01 |
| 468883 | 7/1914 | France . | |
| 615566 | 1/1927 | France | 89/14.3 |
| 912871 | 8/1946 | France . | |
| 469303 | 12/1928 | Germany | 29/1.1 |
| 1053287 | 3/1959 | Germany | 29/1.11 |
| 462064 | 2/1951 | Italy . | |
| 691992 | 7/1965 | Italy . | |
| 4294 | of 1884 | United Kingdom . | |
| 11828 | of 1894 | United Kingdom | 42/79 |
| 4510 | of 1914 | United Kingdom | 42/79 |
| 854516 | 11/1960 | United Kingdom . | |

OTHER PUBLICATIONS

Great Britain patent #9,164; May 1892; FIGS. 1–2 only; no text.

Douglas et al.; Great Britain patent #9,208; May 1892; lone Fig.; no text.

Labisky, The American Rifleman, Jan. 1958, pp. 40–42.

*Primary Examiner*—Stephen M. Johnson

*Attorney, Agent, or Firm*—John P. O'Banion

[57] ABSTRACT

A short length shotgun barrel exhibiting high accuracy and reduced felt recoil, and providing for interchangeability of loads containing shot pellets and slugs. The barrel includes an elongated and tapered forcing cone, a backbored region between the muzzle and the forcing cone, and a muzzle region of smaller diameter than the backbored region. The nominal inside diameter of the barrel from the forcing cone to a point adjacent the muzzle is greater than the muzzle diameter, and the backbored region is roughened at the in proximity to the muzzle. The forcing cone is elongated and tapered down from the chamber toward the muzzle end of the barrel.

13 Claims, 2 Drawing Sheets

SHOTGUN BARREL

CROSS REFERENCE TO RELATED APPLICATIONS

This application is a continuation-in-part of Ser. No. 07/985,328, filed Dec. 4, 1992, now U.S. Pat. No. 5,272,827, which is a divisional of Ser. No. 07/856,512, filed on Mar. 24, 1992, now U.S. Pat. No. 5,249,385.

BACKGROUND OF THE INVENTION 1. Field of the Invention

This invention pertains generally to shotguns, and more particularly to improving the accuracy of shorter length shotgun barrels, reducing felt recoil, and providing for interchangeability of shot pellets and slugs in a single barrel. 2. Description of the Background Art Conventional shotguns employ barrels of various configurations. Most notable are variations in chokes to change the pattern of the shot pellets. Barrel lengths vary also, since the amount of recoil which is felt by the user decreases as the barrel length is increased. Accuracy is also improved by using longer barrels.

A shotgun, however, is generally a short range weapon. As smaller shot is used, a smaller effective range results. The tighter the shot pattern, the more accurate the shotgun is at longer ranges. The size of the pattern is a function of several variables which include the degree of choke if any, the size of the shot, and the load.

Various attempts at improving shotgun barrels, reducing recoil, and increasing accuracy have been made /ver the years. Such approaches, however, nave been directed to standard length barrels and hunting or target applications. In a combat situation, police officers and federal agents often require a short barrelled weapon that can be easily handled or concealed. Barrel lengths of approximately 48 cm or less are often referred to as "riot" shotguns and provide much greater firepower than a pistol. However, as the distance to the target increases, the shot become more dispersed and accuracy suffers. Also, because a shorter barrel weighs less, there is less weight to cushion the recoil which results from the high power of a shot shell load. In addition, in order to change from using a load containing shot pellets to a load containing solid slugs in a combat situation, it is often necessary to change barrels in order to maintain accuracy due to the differing characteristics of the loads.

Therefore, there is a need for a short barrel for combat and law enforcement use that achieves a high degree of accuracy with low recoil characteristics, as well as provides for interchangeability between shot shell loads and solid slugs. The present invention satisfies those needs as well as overcomes the deficiencies found in previously developed barrels.

SUMMARY OF THE INVENTION

The present invention pertains generally improvements in shotgun barrels, and more particularly to a shotgun barrel which achieves high accuracy and low recoil in shorter than conventional lengths, as well as provides for interchangeability between loads containing shot pellets and loads containing slugs without sacrificing accuracy or causing damage to the barrel.

The present invention provides for improved accuracy in smooth bore shotgun barrels with lengths of 56 cm or less, while at the same time reducing recoil and shooter recovery time in manual and automatic cycling of repeating shotguns. The invention also reduces solid projectile dispersal at ranges beyond 23 meters as compared to either conventional choked barrels or unchoked barrels of the same gauge. In addition, both shot pellet and slug loads can be used interchangeably without loss of barrel choke or risk of catastrophic failure by obstruction of the barrel.

Prior to the present invention, no known nonadjustable, fixed choke, shotgun barrel could deliver both choked pattern densities with shot shells and allow the next round to deliver an accurate shotgun fire to the target with subsequent rounds all impacting the target area of 0.9 m×0.9 m when using 00 buckshot at 46 meters from the end of a short barrel. All previously known barrels show loss of pattern density and choke when slug loads and shot pellet loads are mixed into the firing sequence, resulting in loss of choke and wider patterns over the life of the barrel.

The present invention, however, does not suffer from loss of shot pellet accuracy over time when slugs are also used. The present invention allows, for the first time, the interchangeable use of slugs and 00 buckshot at ranges of 46 meters and beyond without requiring a change of barrel or choke tube to preserve accuracy for all projectile types found in standard ammunition. In addition, inert canisters such as those used for tear gas can also be accommodated.

The remarkable characteristics of the shotgun barrel of the present invention are achieved through the implementation of several modifications to a conventional barrel. By means of clarification and not limitation, these modifications can be categorized as backboring, and elongating and tapering the forcing cone.

The barrel of the present invention includes a backbored section wherein the nominal inside diameter of the barrel is increased from the area of the forcing cone to within approximately 12 mm to 80 mm from the muzzle. This technique results in a reduction of deformation of the shot pellets thereby yielding a more accurate flight path. The cup and wad are slowed upon discharge, allowing the shot cluster to exit the barrel ahead of the cup and wad to yield a denser pattern and reduce "felt" recoil. Therefore, the cup and wad do not interfere with the shot cluster upon discharge. This technique overcomes the deficiencies in most short barrel shotguns which have a cylinder bore choke of zero percent reduction and which produce a wide pattern. The present invention, by increasing the inside diameter of the barrel ahead of the muzzle, creates a reduction is the discharge diameter and effectively creates a choke-like discharge port. This condenses the shot string as it exists the muzzle and produces a pattern similar to a full choke.

The forcing cone in a conventional barrel has an abrupt transition from the chamber to the bore. By increasing the length and taper of the forcing cone concentric with the chamber and bore, deformation of the shot pellets is reduced thereby yielding a more accurate flight path. In addition, the time of rearward momentum is increased, thereby yielding less "felt" recoil.

An object of the invention is to provide a high accuracy shotgun barrel in shorter lengths.

Another object of the invention is to increase the tightness of the shot pattern in short barrelled shotguns.

Another object of the invention is to provide a shotgun barrel which reduces the amount of vertical barrel deflection upon discharge of the shotgun.

Another object of the invention is to reduce deformation of shot pellets upon discharge.

Another object of the invention is to reduce the recoil felt by the user of a shotgun.

Another object of the invention is to provide a high accuracy shotgun barrel for combat and law enforcement uses.

Another object of the invention is to provide a shotgun barrel which can accurately fire solid slugs interchangeably with shot pellets.

Another object of the invention is to provide a shotgun barrel which can accurately fire solid slugs interchangeably with shot pellets without loss of choke or pattern in repeated firing applications.

Another object of the invention is to provide a shotgun barrel which can fire inert canisters such as for tear gas, in addition to firing shot pellets and slugs.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
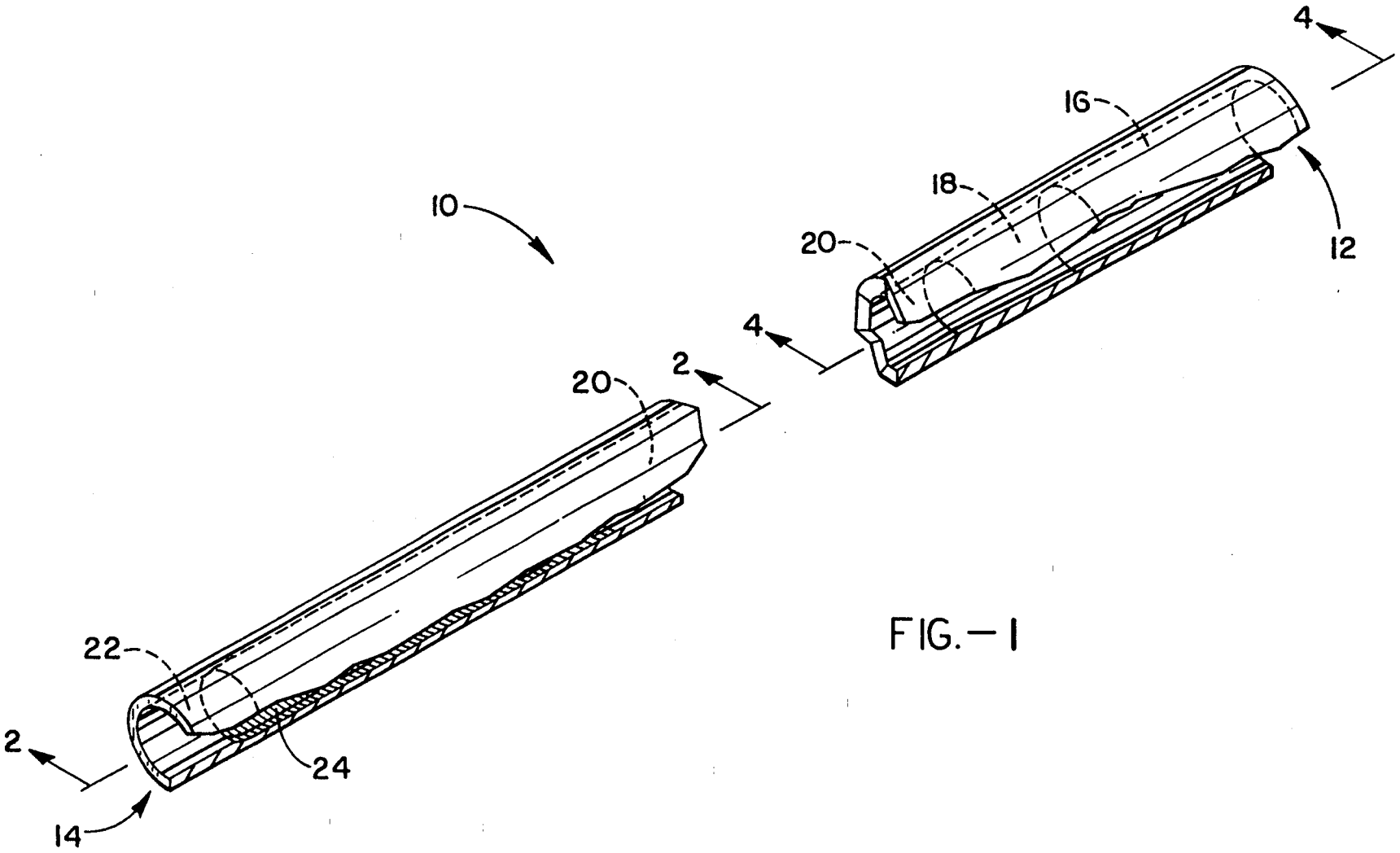
FIG. 1 is a half section view in isometric showing the gun barrel of the present invention.
Figure 2:
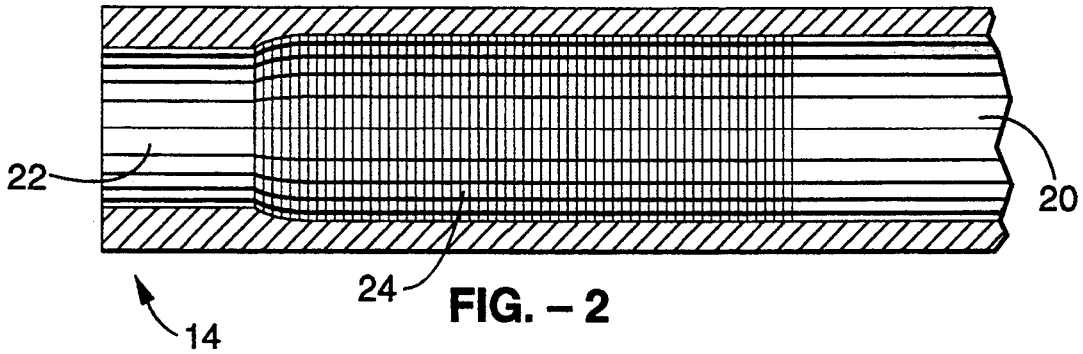
FIG. 2 is a full section view taken through line 2—2 of FIG.1 showing the backboring configuration of the barrel of the present invention.
Figure 4:
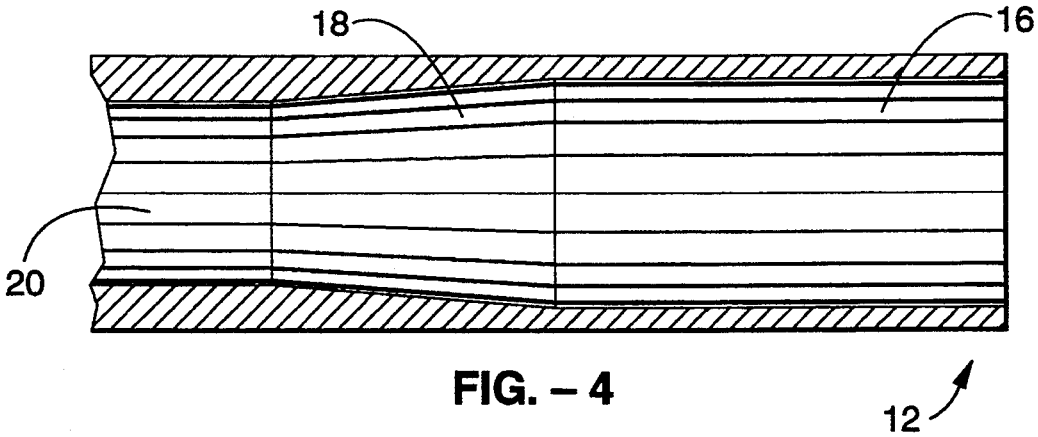
FIG. 4 is a full section view taken through line 4—4 of FIG. 1 showing the forcing cone of the barrel of the present invention.

Referring more specifically to the drawings, for illustrative purposes the present invention is embodied in the barrel generally shown in FIG. 1, FIG. 2, and FIG. 4. It will be appreciated that the invention may vary as to configuration and as to details of the parts without departing from the basic concepts as disclosed herein.

Referring to FIG. 1, the apparatus of the present invention generally comprises a gun barrel 10 which includes a chamber end 12 and a muzzle end 14. Barrel 10 is typically fashioned as a tubular member from steel or the like, and generally comprises a cartridge chamber section 16, a forcing cone section 18, a barrel section 20, and a muzzle section 22, all of which provide a continuous opening between chamber end 12 and muzzle end 14. A cartridge containing slugs or shot load is inserted into cartridge chamber section 16 which is of a substantially uniform diameter throughout its length, and the slugs or shot pellets are discharged from muzzle section 22 which is also of a substantially uniform diameter throughout its length. Preferably both muzzle section 22 and cartridge chamber section 16 have smooth inner surfaces. Note also that the inner diameter of cartridge chamber section 16 is slightly greater than the inner diameter of muzzle section 22.

The inner surface of a portion of the barrel near muzzle end 14 is preferably machined to provide a roughened surface 24. This can be achieved by using a sanding material or a reamer. Preferably the roughening starts at approximately 12 mm to 80 mm from muzzle end 14 and extends toward chamber end 12 for a length of approximately 25 mm to 160 mm. While conventional barrels are polished smooth, roughening the inside of barrel section 20 as described provides for increased accuracy. Because the shot cup and wad will thereby be slowed in speed in relation to the discharge of the slugs or shot, they will not interfere with the discharge pattern.

Referring now to FIG. 2, barrel section 20 is backbored to increase its nominal inner diameter in relation to the inner diameter of muzzle section 22. Preferably, this increase in inner diameter, which is substantially uniform along the length of barrel section 20, begins at a point approximately 12 mm to 80 mm from muzzle end 14, and continues the full length of barrel section 20 until it terminates at forcing cone section 18.

Preferably, the backboring begins approximately 2.54 cm from muzzle end 14. If the backboring begins too close to muzzle end 14, a noticeable decrease in shot pellet or slug condensation will result and accuracy will be lost.

The amount of the increase in diameter can vary, but typically an increase between 0.127 mm and 0.305 mm over the inner diameter of muzzle section 22 is preferred. In applying this technique, it is desirable to achieve as large a diameter increase as possible without reducing the thickness of the barrel wall to a point where fatigue will result. This backboring, which is typically achieved by using a reamer, results in a reduction of deformation of the shot pellets thereby yielding a more accurate flight path. The cup and wad are slowed upon entering roughened area 24, thereby allowing the cluster of shot or slugs to exit muzzle section 22 ahead of the cup and wad to yield a denser pattern and reduce "felt" recoil. Therefore, the cup and wad do not interfere with the shot cluster upon discharge. Furthermore, this technique overcomes the deficiencies in most short barrel shotguns which have a cylinder bore choke of zero percent reduction and which result in a wide pattern. By increasing the inside diameter of barrel section 20 in relation to muzzle section 22, the change in diameter condenses the shot string as it exists the muzzle and produces a pattern similar to a conventional full choke. Note also that the transition point between muzzle section 22 and barrel section 20 is slightly tapered to provide for a more even flow of the slugs or shot pellets when they are compressed and forced into muzzle section 22.

Figure 3:
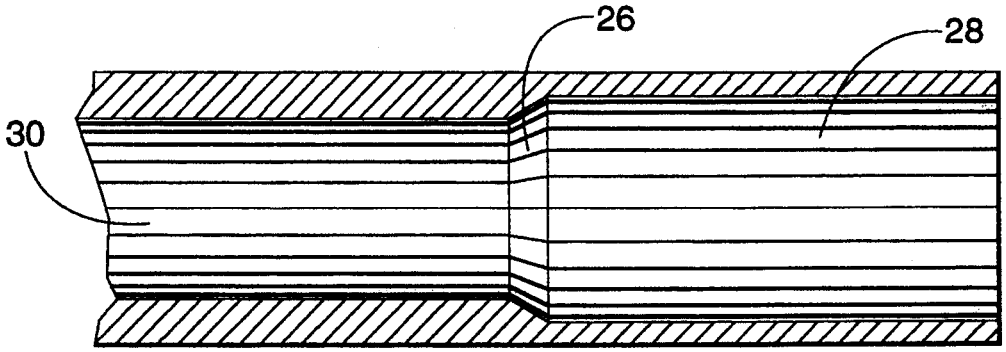
FIG. – 3 PRIOR ART
FIG. 3 is a full section view showing the forcing cone of a conventional shotgun barrel.

Referring to FIG. 3 which represents a conventional barrel, the forcing cone 26 in such a barrel makes an abrupt transition from the chamber 28 to the bore 30. This results in deformation of the slugs or shot pellets as they are forced from the end of the cartridge into the bore 30. However, referring to FIG. 4 which depicts an aspect of the present invention, by increasing the length and taper of the forcing cone section 18 concentric with cartridge chamber section 16 and barrel section 20, there is a reduction of deformation of the slugs or shot pellets thereby yielding a more accurate flight path. In addition, the time of rearward momentum is increased, thereby yielding less "felt" recoil. This is achieved by using a tapered reamer to form a forcing cone section 18 which tapers downward from cartridge chamber section 16 toward barrel section 20. The length of forcing cone 18 section is preferably between 25 mm and 80 mm, but varies as a function of the change in bore diameter between barrel section 20 and cartridge chamber section 16.

It should also be noted that, while the present invention is ideally suited where the length of barrel 10 is 48 cm or less, the methods and apparatus described herein are equally well suited for longer length barrels.

Accordingly, it will be seen that this invention provides a significantly improved shotgun barrel in which high accuracy and lower recoil can be achieved with short length barrels. Although the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. A shotgun barrel having a chamber end and a muzzle end, comprising:

(a) a cartridge chamber, said cartridge chamber positioned adjacent to said chamber end, said cartridge chamber having a bore substantially uniform diameter;

(b) a tapered and elongated forcing cone, said forcing cone positioned between said cartridge chamber and said muzzle end, said forcing cone having a bore, said forcing cone having a length, said forcing cone bore having a diameter, the length of said forcing cone being greater than its bore diameter, the bore diameter of said forcing cone toward said muzzle end being of reduced diameter with respect to the bore diameter of said cartridge chamber;

(c) a barrel section, said barrel section positioned between said forcing cone and said muzzle end, said barrel section having a bore of substantially uniform diameter, said barrel section bore having an inner surface; and (d) a muzzle section, said muzzle section positioned between said barrel section and said muzzle end, said muzzle section having a bore, said muzzle section bore having a diameter, the bore diameter of said muzzle section being of reduced diameter with respect to the bore diameter of said barrel section said inner surface of said barrel section bore being roughened in proximity to said muzzle section.

2. An apparatus as recited in claim 1, wherein the length of said muzzle section is approximately 12 mm to 80 mm.

3. An apparatus as recited in claim 1, wherein the length of said forcing cone is approximately 25 mm to 80 mm.

4. An apparatus as recited in claim 1, wherein the bore diameter of said barrel section is from 0.127 mm to 0.305 mm greater than the bore diameter of said muzzle section.

5. An shotgun barrel, comprising:

(a) a tube, said tube having a generally cylindrical outer wall, said tube having a first end and a second end;

(b) said tube including a first inner section positioned adjacent to said first end, said first inner section having a smooth bore of generally uniform diameter;

(c) said tube including a second inner section positioned adjacent to said first inner section, said second inner section having a smooth bore of reduced diameter with respect to said first inner section, said second inner section having a length being greater than its diameter, said second inner section including an elongated taper extending toward said second end of said tube;

(d) said tube including a third inner section positioned adjacent to said second inner section, said third inner section having a bore of substantially uniform diameter; and (e) a fourth inner section positioned adjacent to said third inner section, said fourth inner section having a smooth bore of reduced diameter with respect to the bore diameter of said third inner section;

(f) said bore of said third inner section being roughened in proximity to said fourth inner section.

6. An apparatus as recited in claim 5, wherein the length of said fourth inner section is approximately 12 mm to 80 mm.

7. An apparatus as recited in claim 5, wherein the length of said second inner section is approximately 25 mm to 80 mm.

8. An apparatus as recited in claim 5, wherein the length of said third inner section is approximately 25 mm to 160 mm.

9. An apparatus as recited in claim 5, wherein the bore diameter of said third inner section is approximately 0.127 mm to 0.305 mm greater than the bore diameter of said fourth inner section.

10. A barrel for a firearm of the type which expels a plurality of shot pellets, comprising:

(a) a muzzle section, said muzzle section having a substantially uniform inner diameter;

(b) a barrel section, said barrel section joined to said muzzle section, said barrel section having a substantially uniform inner diameter greater than the inner diameter of said muzzle section;

(c) an elongated forcing cone section, said forcing cone section joined to said barrel section, said forcing cone section having a taper of increasing diameter away from said barrel section, said forcing cone section having a length greater than its inner diameter; and (d) a chamber section, said chamber section joined to said forcing cone section, wherein said muzzle, barrel, forcing cone, and chamber sections form a continuous barrel said barrel section including a roughened inner surface in proximity to said muzzle section.

11. An apparatus as recited in claim 10, wherein the length of said muzzle section is approximately 12 mm to 80 mm.

12. An apparatus as recited in claim 10, wherein the length of said forcing cone section is approximately 25 mm to 80 mm.

13. An apparatus as recited in claim 10, wherein the inner diameter of said barrel section is approximately 0.127 mm to 0.305 mm greater than the inner diameter of said muzzle section.

* * * * *